US012753624B2

(12) United States Patent
Xie et al.

(10) Patent No.: US 12,753,624 B2
(45) Date of Patent: Oct. 6, 2026

(54) MULTI-STAGE BUCKLING-RESTRAINED BRACE DEVICE

(71) Applicant: Beijing University of Civil Engineering and Architecture, Beijing (CN)

(72) Inventors: Linlin Xie, Beijing (CN); Qianxin Wen, Beijing (CN); Cantian Yang, Beijing (CN); Aiqun Li, Beijing (CN)

( * ) Notice: Subject to any disclaimer, the term of this patent is extended or adjusted under 35 U.S.C. 154(b) by 0 days.

(21) Appl. No.: 19/258,878

(22) Filed: Jul. 2, 2025

(65) Prior Publication Data

US 2025/0382815 A1 Dec. 18, 2025

(30) Foreign Application Priority Data

Sep. 19, 2024 (CN) ..... 202411309763.4

(51) Int. Cl.
*E04H 9/02* (2006.01)

(52) U.S. Cl.
CPC ..... *E04H 9/0237* (2020.05)

(58) Field of Classification Search
CPC ..... E04H 9/02; E04H 9/021; E04H 9/0237; E04B 1/98; E04C 3/02; E04C 3/026
USPC ..... 52/167.1, 167.3, 750
See application file for complete search history.

(56) References Cited

U.S. PATENT DOCUMENTS 7,174,680 B2 * 2/2007 Smelser ..... E04C 3/02 52/167.3
7,185,462 B1 * 3/2007 Smelser ..... E04H 9/0237 52/638
7,188,452 B2 * 3/2007 Sridhara ..... E04H 9/0237 188/266
7,305,799 B2 * 12/2007 Smelser ..... E04C 3/02 52/855
8,590,258 B2 * 11/2013 Hinchman ..... E04H 9/0237 52/167.2
8,763,320 B1 * 7/2014 Chou ..... E04H 12/16 52/167.3
9,016,007 B2 * 4/2015 Marinovic ..... E04H 9/024 52/167.3
2003/0221389 A1 * 12/2003 Smelser ..... E04C 3/02 52/853
2006/0101733 A1 * 5/2006 Jen ..... E04H 9/0237 52/167.1
2006/0253057 A1 * 11/2006 Qi ..... E04H 9/0237 602/23

(Continued)

*Primary Examiner* — James M Ference

(57) ABSTRACT

A multi-stage buckling-restrained brace device. The device comprises the parallel cores system, load-transfer system, and restrainer system. The parallel cores system consists of the energy dissipation component, placed between the two supporting plates. The load-transfer system consists of the first and second supporting plates, which are spaced along a specific direction. The restrainer system consists of the restraining component, which prevents buckling of the energy dissipation component under compression. The restraining component includes a first sliding plate, a second sliding plate, a first connecting component and a second connecting component, while the energy dissipation component includes a first core plate and several high-stage core plates. The first sliding plate is fixedly connected to both the first core plate and the first supporting plate, and the second sliding plate is fixedly connected to both the first core plate and the second supporting plate.

7 Claims, 17 Drawing Sheets

(56) References Cited

U.S. PATENT DOCUMENTS

| | | | | |
|---|---|---|---|---|
| 2008/0250732 | A1* | 10/2008 | Tsai | E04H 9/0237 52/167.3 |
| 2010/0005737 | A1* | 1/2010 | Tsai | E04H 9/0237 52/167.3 |
| 2011/0232221 | A1* | 9/2011 | Tsai | E04H 9/0237 29/897.3 |
| 2013/0139452 | A1* | 6/2013 | Tsai | E04B 1/98 52/655.1 |
| 2015/0000228 | A1* | 1/2015 | Dusicka | E04C 3/29 52/835 |
| 2015/0225951 | A1* | 8/2015 | Tsai | E04C 3/04 52/836 |
| 2015/0225952 | A1* | 8/2015 | Tsai | E04C 3/06 52/836 |
| 2015/0225954 | A1* | 8/2015 | Tsai | E04H 9/0237 52/836 |
| 2015/0225972 | A1* | 8/2015 | Tsai | E04C 3/00 52/848 |
| 2019/0040645 | A1* | 2/2019 | Zhao | E04B 1/2403 |
| 2020/0011051 | A1* | 1/2020 | Hou | E04G 23/02 |
| 2020/0362585 | A1* | 11/2020 | Hou | E04H 9/021 |
| 2023/0038362 | A1* | 2/2023 | Chou | E04H 9/02 |
| 2025/0382815 | A1* | 12/2025 | Xie | E04H 9/0237 |

* cited by examiner

MULTI-STAGE BUCKLING-RESTRAINED BRACE DEVICE

CROSS-REFERENCE TO RELATED APPLICATION

This application claims priority to Chinese Patent Application No. 202411309763.4, filed on Sep. 19, 2024, titled "Multi-stage buckling-restrained brace device" before the China National Intellectual Property Administration, the disclosure of which is incorporated herein by reference in entirety.

TECHNICAL FIELD

The present disclosure relates to the field of structural engineering, and in particular to a multi-stage buckling-restrained brace device.

BACKGROUND

Earthquakes are an inevitable natural disaster. The human casualties and economic losses caused by earthquakes are primarily attributed to the excessive deformation or collapse of building structures. To control the seismic response of building structures, a passive control technology characterized by safety, reliability, and economic efficiency has been proposed. Passive control technology primarily adopts two methods: damping and base isolation technologies. Damping technology, which dissipates seismic energy through dampers, offers improved control of seismic response and reduces damage to structural components, thereby effectively protecting the structure.

Currently, the buckling-restrained braces have been widely used owing to their ease of construction, good ductility, and stable energy dissipation performance. The buckling-restrained brace consists of an energy dissipation core plate (core) and a restraining component. Under external loading, the energy-dissipating core plate bears the entire axial load, while the restraining component only restricts the compressive buckling of the energy dissipation core plate. This configuration enables the energy dissipation core plate to yield under both tension and compression, dissipating energy through the yielding. It is suitable for both new buildings and seismic retrofitting.

However, the existing buckling-restrained braces remain elastic until the energy dissipation core plate yields, after which the load-bearing capacity basically remains constant. A direct consequence of this characteristic is that the performance parameters of the brace are fixed. As a result, it may not sufficiently satisfy the varying demands for energy dissipation under different load conditions from the main structure. Furthermore, once these buckling-restrained braces yield, they must be fully replaced, resulting in high economic costs.

SUMMARY

The purpose of the present disclosure is to provide a multi-stage buckling-restrained brace to solve the technical challenge of the existing buckling-restrained braces, which are unable to adaptively meet the varying load-bearing capacity and energy dissipation demands under different levels of external excitation.

The multi-stage buckling-restrained brace device provided by the present disclosure comprises the parallel cores system, load-transfer system, and restrainer system. The parallel cores system consists of the energy dissipation component, placed between the two supporting plates. The load-transfer system consists of the first and second supporting plates, which are spaced along a specific direction. The restrainer system consists of the restraining component, which prevents buckling of the energy dissipation component under compression.

The restraining component comprises a first sliding plate, a second sliding plate, a first connecting component, and a second connecting component. The energy dissipation component comprises a first core plate and several high-stage core plates arranged in parallel with the first core plate. The first sliding plate is fixedly connected to the first end of the first core plate and the first supporting plate. Similarly, the second sliding plate is fixedly connected to the second end of the first core plate and the second supporting plate. The two ends of the high-stage core plates are respectively spaced from the first and second supporting plates to form adjustable gaps between the high-stage core plates and the supporting plates. Each high-stage core plate provides a first long hole at a first end and a second long hole at a second end, wherein both long holes extend along the first direction. The first sliding plate is provided with a first connection hole opposite to the first long hole, and the first connecting component passes through both the first connection hole and the first long hole. Similarly, the second sliding plate is provided with a second connection hole opposite to the second long hole, and the second connecting component passes through both the second connection hole and the second long hole. The high-stage core plates are provided with at least one adjustable gap.

According to some embodiments of the present disclosure, the number of high-stage core plates is two, which are defined as the second and third core plates. The second and third core plates are respectively arranged on both sides of the first core plate along a second direction, which is perpendicular to the first direction. Furthermore, the adjustable gap provided between the second core plate and the corresponding supporting plate is different from that between the third core plate and the corresponding supporting plate. The second direction is perpendicular to the first direction.

According to some embodiments of the present disclosure, the restraining component further comprises a lateral restraining plate arranged on a side of the energy dissipation component. The lateral restraining plate is provided with a first limiting slot near the first supporting plate and the energy dissipation component, and a second limiting slot near the second supporting plate and the energy dissipation component. The first and second sliding plates are accommodated within the first and second limiting slots, respectively. Along the first direction, the sliding displacement of the first and second sliding plates within the first and second limiting slots both exceeds the sliding displacement of the first and second connecting components within the first and second long holes, respectively. The lateral restraining plate and the energy dissipation component are arranged along a third direction, which is perpendicular to both the first and second directions.

According to some embodiments of the present disclosure, the restraining component further comprises a third and fourth connecting component. The lateral restraining plate provides a first safety hole at one end and a second safety hole at the other end, both of which extend along the first direction. The first supporting plate is provided with a corresponding supporting plate hole aligned with the first safety hole, and the second supporting plate is provided with a corresponding hole opposite to the second safety hole. The third connecting component passes through both the first supporting plate hole and the first safety hole, and along the first direction. Similarly, the fourth connecting component passes through both the second supporting plate hole and the second safety hole, and along the first direction.

The sliding displacement for both the third connecting component in the first safety hole and the fourth connecting component in the second safety hole exceeds the sliding displacement of the first and second connecting components within their respective long holes.

According to some embodiments of the present disclosure, each of the first, second, and third core plates comprises a transition segment, corresponding to the first, second, and third transition sections, respectively and two connection segments at opposing ends, corresponding to the first, second, and third connection sections, respectively. The connection segments of each core plate are configured to connect to the first and second supporting plates, respectively. A first restraining space is provided between the first and second transition segments, and a second restraining space is provided between the first and third transition segments. The restraining component further comprises the first and second intermediate restraining plates. The first and second intermediate restraining plates are located in the first and second restraining spaces, respectively, and both the first and second intermediate restraining plates are fixedly connected to the lateral restraining plate.

According to some embodiments of the present disclosure, along the third direction, the size of the first and second intermediate restraining plates is both 0.5 to 3 mm larger than that of the energy dissipation component.

According to some embodiments of the present disclosure, the restraining component further comprises a top restraining plate and a bottom restraining plate, which are arranged on opposite sides of the energy dissipation component (300) along the third direction and contact it. Both the top and bottom restraining plates are fixedly connected to the lateral restraining plate.

According to some embodiments of the present disclosure, the cross-sections of the top and bottom restraining plates are both T shape, wherein the vertical section of the T shape contacts the energy dissipation component (300), and the horizontal section of the T shape is fixedly connected to the lateral restraining plate.

And/or, the cross-section of the lateral restraining plate is [ shape, with the vertical section connected to the first supporting plate, the energy dissipation component (300), and the second supporting plate. The horizontal section of the [ shape is fixedly connected to the top and bottom restraining plates.

According to some embodiments of the present disclosure, two lateral restraining plates are provided, positioned on opposite sides of the energy dissipation component along the third direction.

According to some embodiments of the present disclosure, each of the first and second supporting plates comprises a connecting plate, corresponding to the first and second connecting plates, respectively, and several first rib plates arranged on the first and second connecting plates. The first and second connecting plates are configured to connect with the energy dissipation component.

And/or, wherein the energy dissipation component is detachably connected to the first supporting plate, the second supporting plate, and the restraining component.

The beneficial effects of the multi-stage buckling-restrained brace device proposed in the present disclosure are as follows.

The multi-stage buckling-restrained brace device primarily consists of the energy dissipation component, the first and second supporting plates, and the restraining component. When subjected to a changing axial load, a relative displacement occurs between the first and second supporting plates along the first direction. This axial load is transferred through the first and second sliding plates to the first core plate, causing the first core plate to undergo yielding. This initial yielding constitutes the first working stage. During this stage, due to the intentional gaps between the two ends of the high-stage core plate and both the first and second supporting plates, the high-stage core plate does not participate in the work. Specifically, the first and second supporting plates will not contact the high-stage core plate in the initial stage of relative sliding motion, and the first and second connecting components will not contact the hole wall of the first and second long holes.

The present invention is exemplified by a configuration with two high-stage core plates having different adjustable gaps. After the initial yielding of the first core plate, a subsequent working stage is activated once the displacement is sufficient to close the smaller of these two gaps. This activation occurs when either of two conditions is met: (a) the first and second supporting plates make direct contact with the ends of the high-stage core plate that has the smaller adjustable gap; (b) the first and second connecting components associated with that high-stage core plate travel the full length of their respective long hole and make contact with the hole walls of the corresponding first and second long holes. This means that, at this stage, the first core plate and the high-stage core plate deform together to dissipate energy.

This process continues with further displacement. The first and second supporting plates contact the high-stage core plate with a larger adjustable gap, or when the first and second connecting components connected to the high-stage core plate moves with the first and second sliding plate to contact the hole wall of the corresponding first and second long holes, the high-stage core plate with a larger adjustable gap will yield. This means that, at this stage, the first core plate and the multiple high-stage core plates cooperate to deform and dissipate energy. This sequential activation enables an adaptive load-deformation response from the energy dissipation component. In this way, the multi-stage buckling-restrained brace device can meet the varied strength, stiffness, and energy dissipation demands of the main structure under different levels of external excitation.

It can be seen from this that the multi-stage buckling-restrained brace device can adaptively adjust the overall load-bearing and energy dissipation capacities in the initial stage by adjusting the mechanical properties of the first core plate, thereby achieving multi-stage energy dissipation capacity capabilities. This design effectively meets the different load-bearing and energy dissipation demands of the main structure under different levels of external excitation, significantly enhancing structural adaptability and safety.

BRIEF DESCRIPTION OF THE DRAWINGS

To better illustrate the embodiments of the present disclosure or the technical solutions in the prior art, the drawings used in the embodiments or the prior art description will be briefly introduced below. It is evident that the drawings described below are only represent embodiments of the present disclosure. For ordinary technicians in this field, additional drawings can be obtained based on the provided drawings without paying for creative work.

DESCRIPTION OF REFERENCE NUMERALS

100—first supporting plate; 110—first connecting plate; 111—first supporting plate hole; 120—first rib plate; 200—second supporting plate; 210—second connecting plate; 211—second supporting plate hole; 220—second rib plate; 300—energy dissipation component; 400—restraining component; 500—adjustable gap; 600—first restraining space; 700—second restraining space; 810—fifth connecting component; 820—sixth connecting component; 830—seventh connecting component; 840—eighth connecting component; 850—core board connecting component; 860—ninth connecting component; 870—tenth connecting component;

310—first core plate; 311—first transition segment; 312—first connection segment; 320—second core plate; 321—second transition segment; 322—second connection segment; 330—third core plate; 331—third transition segment; 332—third connection segment; 340—first long hole; 350—second long hole;

410—first sliding plate; 411—first connection hole; 420—second sliding plate; 421—second connection hole; 431—first connecting component; 432—second connecting component; 440—lateral restraining plate; 441—first limiting slot; 442—second limiting slot; 443—first safety hole; 444—second safety hole; 451—third connecting component; 452—fourth connecting component; 460—first intermediate restraining plate; 470—second intermediate restraining plate; 480—top restraining plate; 490—bottom restraining plate.

DETAILED DESCRIPTION OF EMBODIMENTS

To more clearly and comprehensively understand the aforementioned objects, features, and advantages of the present disclosure, the specific embodiments of the present disclosure are described in detail below with reference to the accompanying drawings. It should be understood that the specific embodiments described herein are only used for the purpose of explaining the present disclosure and are not used to limit the present disclosure.

Figure 1:
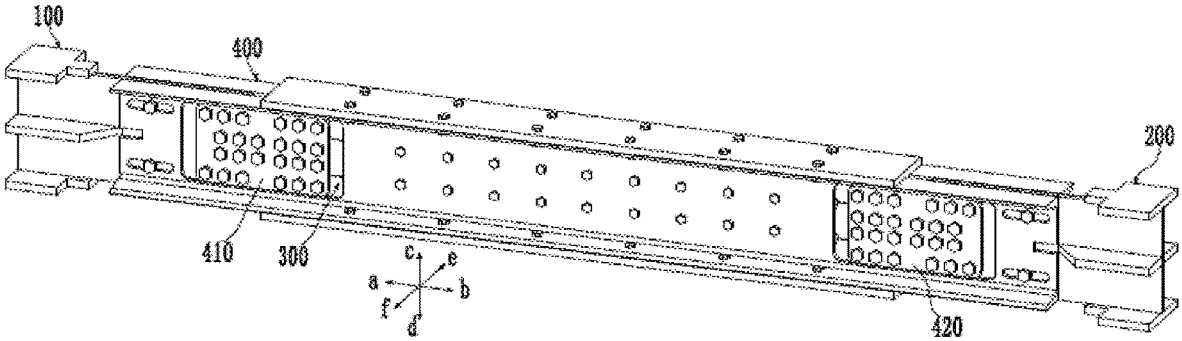
FIG. 1 is a three-dimensional view of a multi-stage buckling-restrained brace device according to an embodiment of the present disclosure.

Referring to FIG. 1, a three-dimensional view of a multi-stage buckling-restrained brace device in one embodiment is presented. The device comprises a first supporting plate 100 and a second supporting plate 200, which are spaced apart from each other along a first direction. An energy dissipation component 300 is located between the first and second supporting plates (100, 200). A restraining component 400 is provided to constrain the energy dissipation component 300 from buckling under compression.

Figure 2:
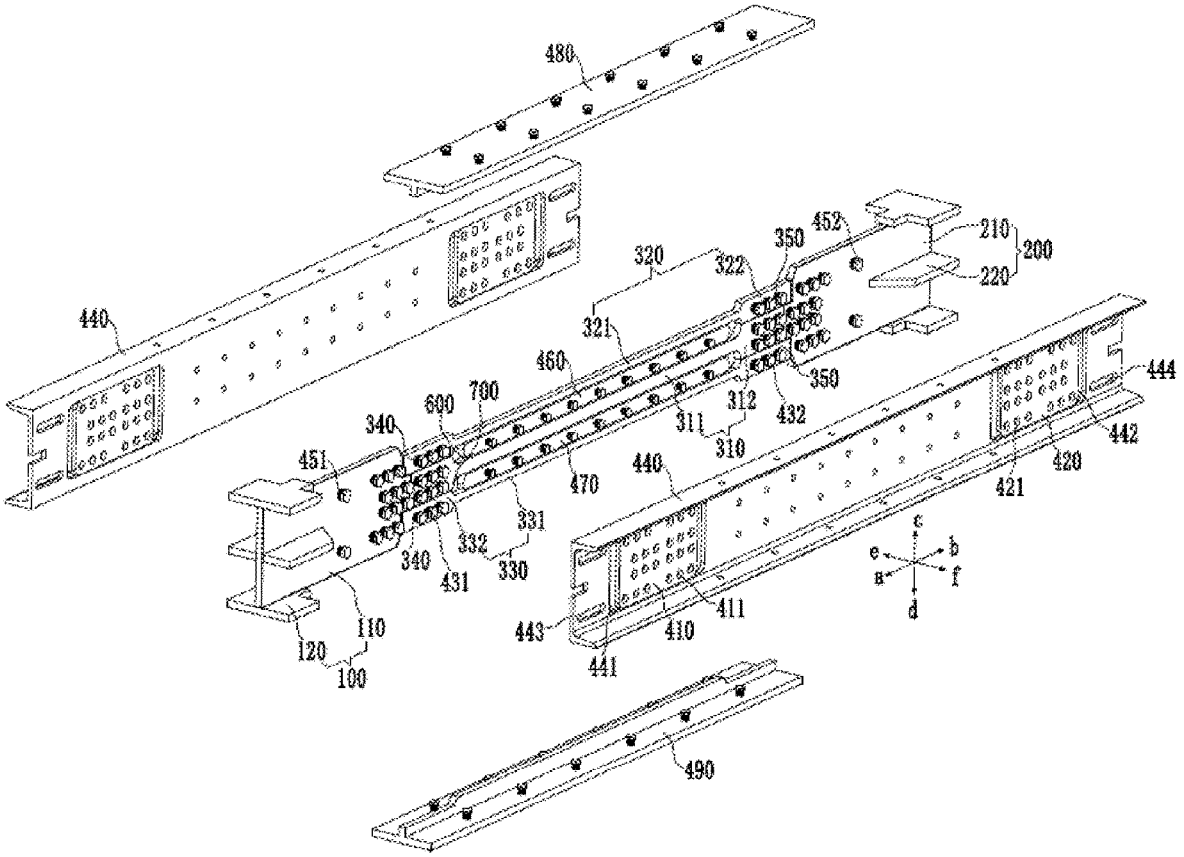
FIG. 2 is a first structural exploded view of the multi-stage buckling-restrained brace device according to an embodiment of the present disclosure.
Figure 3:
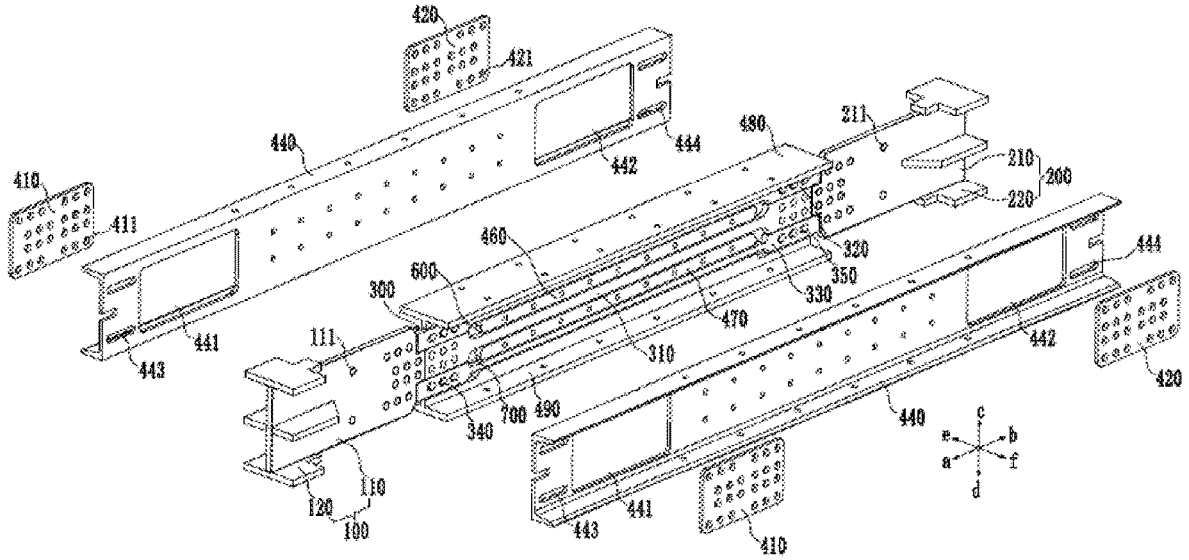
FIG. 3 is the second structural exploded view of the multi-stage buckling-restrained brace device according to an embodiment of the present disclosure.
Figure 4:
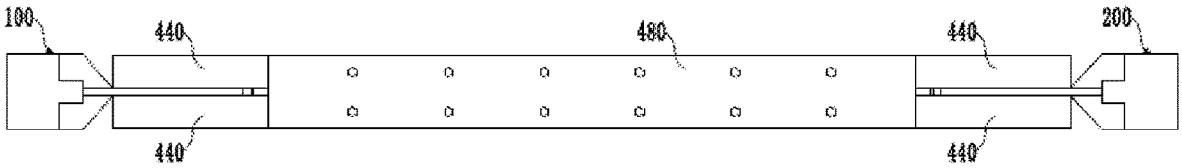
FIG. 4 is a top view of the multi-stage buckling-restrained brace device according to an embodiment of the present disclosure.
Figure 5:
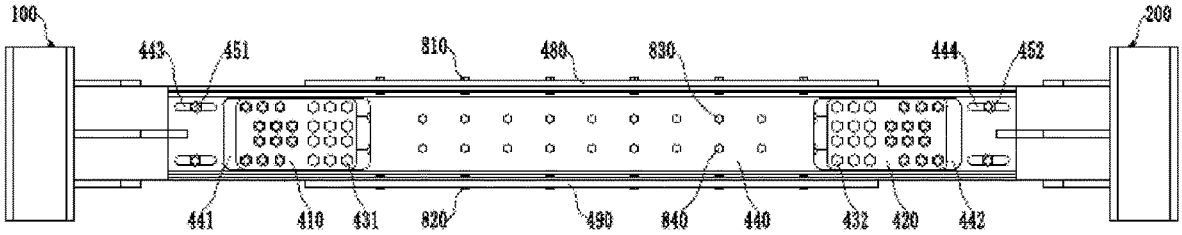
FIG. 5 is a front view of the multi-stage buckling-restrained brace device according to an embodiment of the present disclosure.

Referring to FIGS. 2-5, additional views of the multi-stage buckling-restrained brace device in this embodiment are presented. Specifically, FIGS. 2 and 3 show first and second structural exploded views of the device, respectively. FIG. 4 illustrates a top view, and FIG. 5 illustrates a front view of the device.

As shown in FIGS. 1-5, an embodiment of the multi-stage buckling-restrained brace device is described. The restraining component 400 may include the first and second sliding plates (410, 420) and the first and second connecting components (431, 432). The energy dissipation component 300 includes a first core plate 310 and multiple of high-stage core plates arranged in parallel with the first core plate 310. The first sliding plate 410 is fixedly connected to the first end of the first core plate 310 and the first supporting plate 100, while the second sliding plate 420 is fixedly connected to the second end of the first core plate 310 and the second supporting plate 200. The two ends of the high-stage core plate are respectively spaced from the first supporting plate 100 and the second supporting plate 200. An adjustable gap 500 is provided between the high-stage core plate and the first supporting plate 100 and the second supporting plate 200. Each high-stage core plate opens/forms a first long hole 340 at the first end and a second long hole 350 at the second end. The first and second long holes (340, 350) both extend along the first direction. The first sliding plate 410 is opened/formed with a first connection hole 411 that is opposite to the first long hole 340. Similarly, the second sliding plate 420 is opened/formed with a second connection hole 421 that is opposite to the second long hole 350. This arrangement allows the first connecting component 431 to pass through the first connection hole 411 and the first long hole 340, and the second connecting component 432 to pass through the second connection hole 421 and the second long hole 350. The several high-stage core plates have at least one kind of adjustable gap 500.

It should be noted that directional references are defined with respect to the accompanying figures. In this embodiment, as shown in FIGS. 1 to 3. The "first direction" is indicated by the arrows a, b; the "second direction" is indicated by arrows c, d; and the "third direction" is indicated by the arrows e, f.

Figure 6:
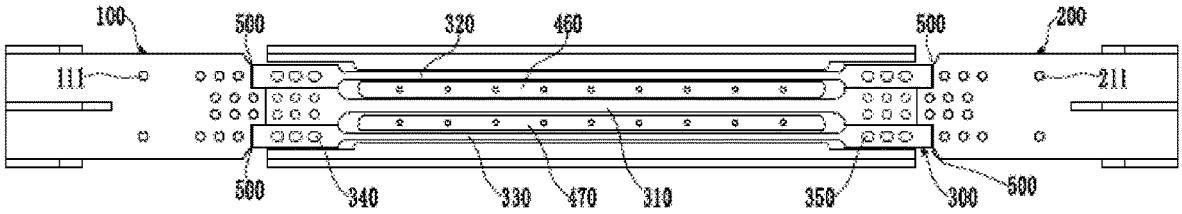
FIG. 6 is a partial front view of the multi-stage buckling-restrained brace device according to an embodiment of the present disclosure.

FIGS. 1, 2, and 6 illustrate a specific embodiment of the multi-stage buckling-restrained brace device. In this embodiment, there are two high-stage core plates, namely the second core plate 320 and the third core plate 330. The adjustable gap 500 formed between the second core plate 320 and the corresponding supporting plate is different from the adjustable gap 500 formed between the third core plate 330 and the corresponding supporting plate.

Figure 7:
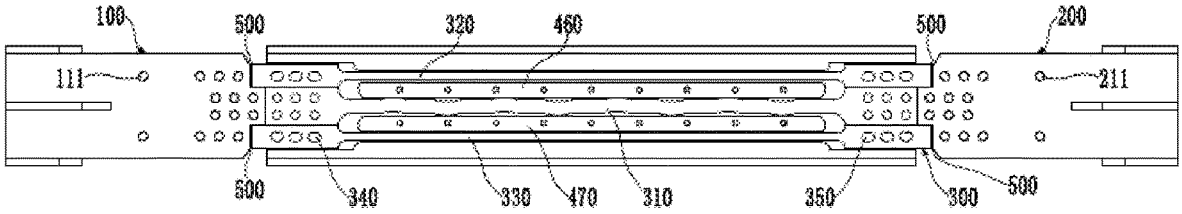
FIG. 7 is a partial front view of the multi-stage buckling-restrained brace device according to an embodiment of the present disclosure, in which only the first core plate undergoes buckling deformation in the initial phase.

FIG. 7 illustrates the initial working stage of the multi-stage buckling-restrained brace device in this embodiment. During this stage, a change in axial load causes the first and second supporting plates (100, 200) to displace relative to each other along the first direction. The axial load is transferred through the first and second sliding plates (410, 420) to the first core plate 310, causing it to undergo yielding. This initial stage exclusively involves the first core plate 310. The second and third core plates (320, 330) do not participate in the work for two reasons. First, the adjustable gaps prevent the first and second supporting plates (100, 200) from making direct contact with the second and third core plates (320, 330). Second, the first and second connecting components (431, 432) have not yet traveled the full length of the first and second long holes to make contact with the hole walls.

Figure 8:
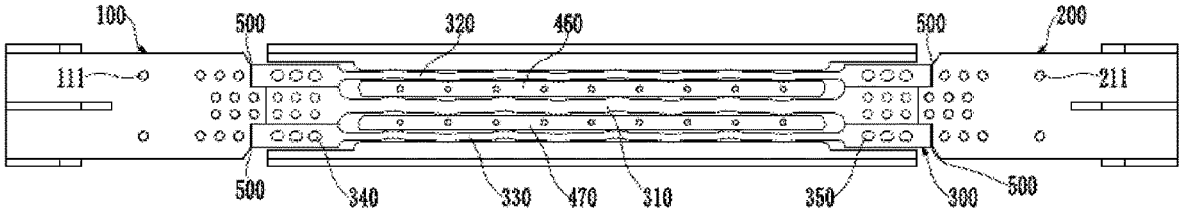
FIG. 8 is a partial front view of the multi-stage buckling-restrained brace device according to an embodiment of the present disclosure, in which the first core plate, the second core plate, and the third core plate all undergo buckling deformation in a subsequent phase.

FIG. 8 illustrates a subsequent working stage of the multi-stage buckling-restrained brace device in this embodiment. This stage is activated when the displacement from the initial yielding of the first core plate 310 becomes large enough to engage the high-stage core plate with the smaller adjustable gap 500. All three core plates (310, 320, 330) undergo buckling deformation in the stage. This activation occurs when either of two conditions is met: (a) the first and second supporting plates (100, 200) make direct contact with the ends of the high-stage core plate; (b) the first and second connecting components (431, 432) connected to the high-stage core plate moves with the first and second sliding plates (410, 420) to contact the hole wall of the corresponding first and second long hole (340, 350). In this state, the high-stage core plate with a smaller adjustable gap 500 will yield and deform. At this point, the first core plate 310 and the high-stage core plate deform together, providing a second stage of energy dissipation.

With continued displacement, the final working stage is activated. The last remaining high-stage core plate with the larger adjustable gap 500 is activated through the same mechanisms previously described: (a) the first and second supporting plates (100, 200) make direct contact with the ends of the last remaining high-stage core plate; (b) the first and second connecting components (431, 432) connected to the last remaining high-stage core plate moves with the first and second sliding plates (410, 420) to contact the hole wall of the corresponding first and second long hole (340, 350). The high-stage core plate with a larger adjustable gap 500 will yield. At this stage, the first core plate 310 and all the high-stage core plates deform together, providing the maximum energy dissipation capacity of the device. In this way, the adaptive regulation of different load-bearing capacities and energy dissipation performances of the energy dissipation component 300 is achieved. This multi-stage activation mechanism allows the multi-stage buckling-restrained brace device to adapt its stiffness and energy dissipation capacity to meet the specific performance demands of a structure under different levels of external excitation.

It can be seen from this that the multi-stage buckling-restrained brace device can flexibly adjust the load-bearing capacity and energy dissipation performance in the initial stage by adjusting the mechanical properties of the first core plate 310. This design ensures the device can effectively meet the varying performance demands of a structure under different levels of external excitation.

In addition, in the present disclosure, the side-by-side arrangement of the first core plate 310 and the high-stage core plates creates longitudinal overlap among the components. This parallel configuration provides redundancy. Therefore, the failure of any individual core plate during operation does not lead to a complete loss of energy dissipation capacity of the device. This design feature significantly improves the safety and reliability of the device, particularly under strong seismic events, by ensuring continued performance even after partial component damage.

Moreover, the parallel configuration of the first core plate 310 and the high-stage core plates enables sequential activation. As the displacement between the first and second supporting plates (100, 200) increases, each core plate is working in a pre-determined order, achieving multi-stage yielding. This design provides enhanced flexibility. The adjustable parameters include not only the strength and sectional area of each core plate, but also the deformation threshold at which each high-stage core plate is activated. This offers a significant advantage over prior art devices where core plates are connected in series, as those designs typically only adjust the strength and cross-sectional area of the energy dissipation core plate. Furthermore, this design can also reduce the space occupied along the first direction, and is suitable for building structures with limited space.

In addition, this parallel arrangement of the first core plate 310 with the high-stage core plates provides a significant structural advantage. The total axial load-bearing capacity of the device is the cumulative sum of the individual capacities of all engaged core plates. Compared with the solution that connects multiple energy dissipation core plates in series in the prior art, the total load-bearing capacity is limited to that of a single energy-dissipation core plate. Therefore, the design of the present disclosure allows for a significantly higher load-bearing capacity that can be tailored to specific design demands.

Figure 9:
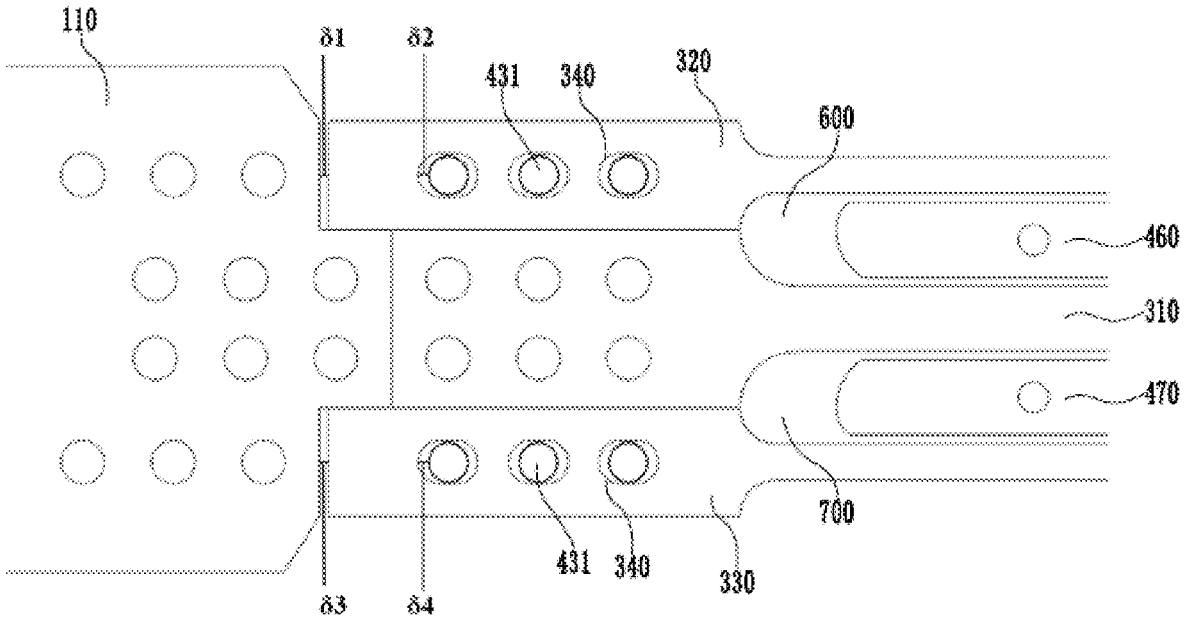
FIG. 9 is a partial enlarged view of the multi-stage buckling-restrained brace device according to an embodiment of the present disclosure.

FIG. 9 provides a partial enlarged view of the multi-stage buckling-restrained brace device in this embodiment, illustrating the adjustable gaps that define the multi-stage activation. For this embodiment, the following variables are defined: δ1 is defined as the adjustable gap 500 between the second core plate 320 and the first supporting plate 100; δ2 is defined as the distance between the first connecting component 431 passing through the first long hole 340 of the second core plate 320 and the hole wall of the first long hole 340; δ3 is defined as the adjustable gap 500 between the third core plate 330 and the first supporting plate 100; δ4 is defined as the distance between the first connecting component 431 passing through the first long hole 340 of the third core plate 330 and the hole wall of the first long hole 340. Wherein δ1=δ2 and δ3-δ4.

The aforementioned embodiment describes the case where the adjustable gap 500 formed between the second core plate 320 and the corresponding supporting plate is different from the adjustable gap 500 formed between the third core plate 330 and the corresponding supporting plate, that is, δ1≠δ3. For the purpose of explanation, the following working mechanism assumes δ1<δ3. This configuration allows the multi-stage buckling-restrained brace device to achieve three-stage energy dissipation, providing adaptive stiffness and energy dissipation capacity under different levels of earthquakes. The specific working mechanism is as follows.

Figure 10:
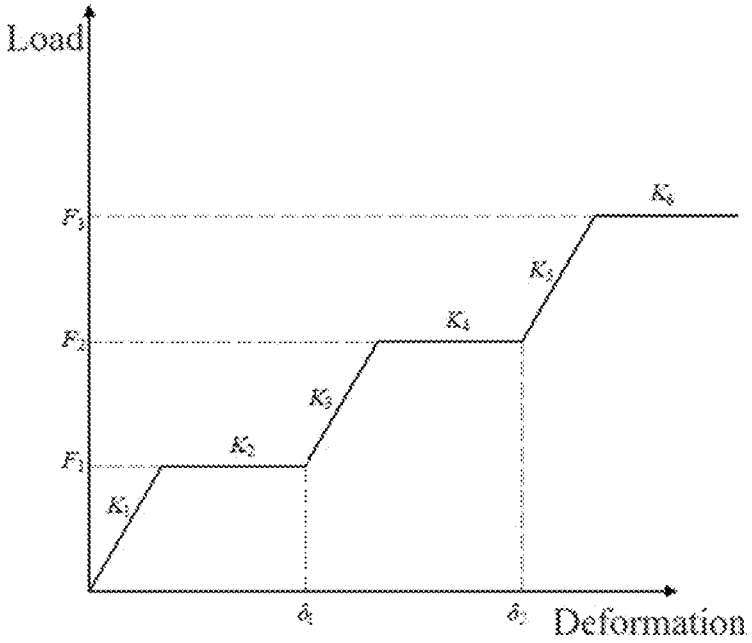
FIG. 10 is a schematic view of the load-displacement relationship of the multi-stage buckling-restrained brace device according to an embodiment of the present disclosure, showing different adjustable gaps between the second and third core plate and the corresponding supporting plates.

FIG. 10 illustrates a schematic view of the load-displacement relationship for an embodiment where the adjustable gaps (δ1, δ3) are unequal (i.e., δ1≠δ3). Under the service level earthquake or wind load, the inter-story drift of the structure is small, and the axial deformation of the brace is less than 2 times of δ1. Consequently, neither the second core plate 320 nor the third core plate 330 makes contact with the first supporting plate 100 or the second supporting plate 200. The energy dissipation mechanism of the multi-stage buckling-restrained brace device is only provided by the first core plate 310, and the maximum load-bearing capacity is F1.

Under the design basis earthquake, the inter-story drift of the structure is slightly increased compared to the service level earthquake; the axial deformation of the device remains below 2 times of δ1. The two ends of the second and third core plates (320, 330) are still not in contact with the first and second supporting plates (100, 200). The energy dissipation mechanism of the multi-stage buckling-restrained brace device is still provided by the first core plate 310. At this time, the maximum load-bearing capacity is F1.

Under the maximum considered earthquake, the inter-story drift of the structure is significantly increased compared to the design basis earthquake. The axial deformation of the device is greater than 2 times of δ1 but less than 2 times of δ2. This level of deformation is sufficient to close the adjustable gap of the second core plate 320, resulting in the two ends of the second core plate 320 coming into contact with the first supporting plate 100 and the second supporting plate 200, respectively. However, the third core plate 330 does not contact the first supporting plate 100 or the second supporting plate 200. The energy dissipation mechanism of the multi-stage buckling-restrained brace device is provided jointly by the first and second core plates (310, 320). At this time, the maximum load-bearing capacity is F2.

Under the very rare earthquake, the inter-story drift of the structure is significantly increased compared to the maximum considered earthquake. The axial deformation of the device is greater than 2 times of δ2. At this level of deformation, all adjustable gaps in the device are closed, and the two ends of the second and third core plates (320, 330) are respectively in contact with the first supporting plate 100 and the second supporting plate 200. The energy dissipation mechanism of the multi-stage buckling-restrained brace device is jointly provided by the first, second, and third core plates (310, 320, 330). At this time, the maximum load-bearing capacity is F3.

It can be understood that in other embodiments, the adjustable gap 500 formed between the second core plate 320 and the corresponding supporting plate can also be set to be the same as the adjustable gap 500 formed between the third core plate 330 and the corresponding supporting plate. Specifically in FIG. 9, this corresponds to a configuration where δ1=δ3 (and therefore δ1=δ2=δ3=δ4). In this case, the multi-stage buckling-restrained brace device provides a two-stage energy dissipation mechanism. This allows the device to adaptively provide multi-level load-bearing capacity and energy dissipation capacity under different levels of earthquakes. The specific working mechanism for this two-stage configuration is as follows.

Figure 11:
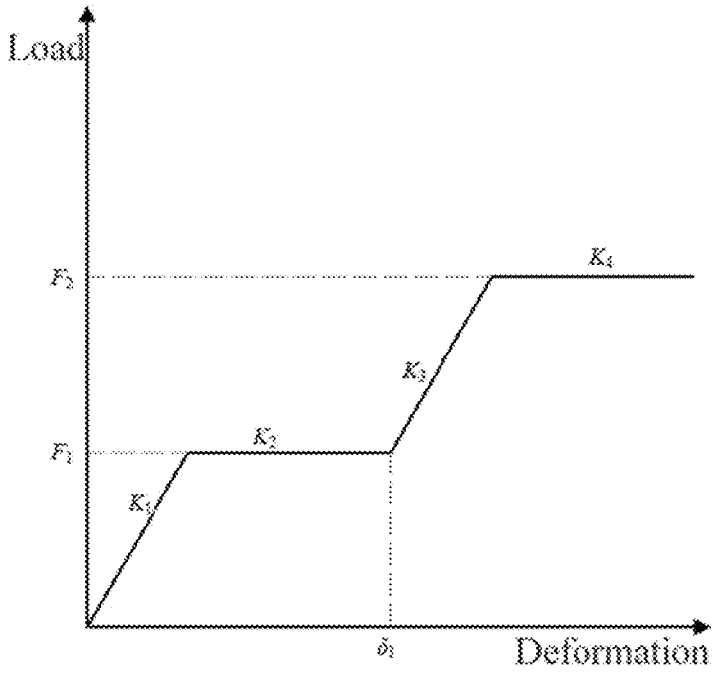
FIG. 11 is a schematic view of the load-displacement relationship of the multi-stage buckling-restrained brace device according to an embodiment of the present disclosure, showing different adjustable gaps between the second and third core plate and the corresponding supporting plates are the same.

FIG. 11 illustrates a schematic view of the load-displacement relationship where the adjustable gaps are equal (i.e., δ1=δ3). This configuration results in a two-stage performance. Under the service level earthquake or wind load, the inter-story drift of the structure is small, and the axial deformation of the device is less than 2 times of δ1. The second and third core plates (320, 330) are not in contact with the first and second supporting plates (100, 200). In this stage, only the first core plate 310 is worked, providing a maximum load-bearing capacity of F1.

Under design basis earthquake, the inter-story drift of the structure is slightly increased compared to the service level earthquake. The axial deformation of the device remains less than 2 times of δ1. The two ends of the second and third core plates (320, 330) are still not in contact with the first and second supporting plates (100, 200). The energy dissipation mechanism of the multi-stage buckling-restrained brace device is still provided by the first core plate 310. At this time, the maximum load-bearing capacity is F1.

Under maximum considered earthquake, the inter-story drift of the structure is significantly increased compared to the design basis earthquake. The axial deformation of the device is greater than 2 times of δ1. The two ends of the second and third core plates (320, 330) are in contact with the first supporting plate 100 and the second supporting plate 200, respectively. The energy dissipation mechanism of the multi-stage buckling-restrained brace device is provided by the first, second, and third core plates (310, 320, 330). At this time, the maximum load-bearing capacity is F2.

It can be seen that the multi-stage buckling-restrained brace device can achieve a variety of staged energy dissipation characteristics by flexibly adjusting the lengths of the first and second long holes (340, 350) on the high-stage core plates and the sizes of the adjustable gaps 500 between the core plates and the first and second supporting plates (100, 200). This allows the stiffness, load-bearing capacity, and energy dissipation capacity of the device to be precisely engineered to meet specific performance objectives under different levels of deformation.

Referring to FIGS. 2, 3, and 6, in this embodiment, the second and third core plates (320, 330) are respectively arranged on the sides of the first core plate 310 along the second direction. The first, second, and third core plates (310, 320, 330) are arranged side-by-side.

The aforementioned arrangement of the first, second, and third core plates (310, 320, 330) enables the first core plate 310 that begins to bend and deform in the initial stage to be located in the middle of the energy dissipation component 300. The second and third core plates (320, 330) that begin to bend and deform in the subsequent stage are located on both sides. This not only effectively constrains both sides of the first core plate 310 along the second direction, but also ensures the uniformity of the energy dissipation component 300 during the load-bearing process.

Referring to FIGS. 2 and 3, in this embodiment, the restraining component 400 may further include a restraining plate arranged on a side of the energy dissipation component 300. Specifically, the lateral restraining plate 440 is provided with a first limiting slot 441 at a position adjacent to the first supporting plate 100 and the energy dissipation component 300, and a second limiting slot 442 at a position adjacent to the second supporting plate 200 and the energy dissipation component 300. The first and second sliding plates (410, 420) are accommodated in the first and second limiting slots (441, 442), respectively. Along the first direction, the sliding distance of the first and second sliding plates (410, 420) in the first and second limiting slots (441, 442) are both greater than the sliding distance of the first and second connecting components (431, 432) in the first and second long holes (340, 350). The lateral restraining plate 440 and the energy dissipation component 300 are arranged along a third direction, which is perpendicular to both the first and the second directions.

The configuration of the aforementioned lateral restraining plate 440 can constrain the buckling deformation of the energy dissipation component 300 along the third direction. Specifically, it is also possible to avoid interference between the first and second sliding plates (410, 420) and the lateral restraining plate 440 during the buckling deformation of the energy dissipation component 300 by providing the first and second limiting slots (441, 442) for accommodating the first and second sliding plates (410, 420) on the lateral restraining plate 440. At the same time, the sliding mechanism of the first and second sliding plates (410, 420) in the first and second limiting slot (441, 442) can be utilized to guide the movement process of the first and second sliding plates (410, 420), thereby avoiding the first and second sliding plates (410, 420) from moving along the second direction.

Referring to FIG. 2, in this embodiment, there are two lateral restraining plates 440 which are arranged on both sides of the energy dissipation component 300 along the third direction.

By providing the lateral restraining plates 440 on both sides of the energy dissipation component 300 along the third direction, restraining effects can be generated on both sides of the energy dissipation component 300 along the third direction, and the restraining effects are good.

Referring to FIG. 2, in this embodiment, the restraining component 400 may further include the third and fourth connecting component (451, 452).

Specifically, the lateral restraining plate 440 provides a first safety slot 443 at one end and a second safety slot 444 at the opposite end along the first direction. The first supporting plate 100 is provided with a first supporting plate hole 111 opposite to the first safety slot 443, and the second supporting plate 200 is provided with a second supporting plate hole 211 opposite to the second safety slot 444. Along the first direction, the sliding stroke of the third and fourth connecting components (451, 452) in the first and second safety holes (443, 444) is greater than the sliding stroke of the first connecting component 431 in the first long hole 340 and the sliding stroke of the second connecting component 432 in the second long hole 350.

The first and second safety holes (443, 444) at both ends of the lateral restraining plate 440 and their corresponding connecting components (451, 452), which are connected to the first and second supporting plates (100, 200), provide a failsafe mechanism for the device. Specifically, when the first and second connecting components (431, 432) move to the maximum stroke in the first and second long holes (340, 350), as the energy dissipation component 300 continues to deform, the first and second safety holes (443, 444) can play a further limiting role to prevent the multi-stage buckling-restrained brace device from supporting plate damage.

Referring to FIG. 2, in this embodiment, each of the first, second, and third core plates (310, 320, 330) has a similar structure, comprising a transition segment (311, 321, 331) and two connection segments (312, 322, 332) at its opposing ends. The first, second, and third connection segments (312, 322, 332) of each plate connect to the first and second supporting plates (100, 200), respectively. A first restraining space 600 is formed between the first transition segment 311 and the second transition segment 321, and a second restraining space 700 is formed between the first transition segment 311 and the third transition segment 331. The restraining component 400 further includes the first and second intermediate restraining plates (460, 470). The first intermediate restraining plate 460 is located in the first restraining space 600, and the second intermediate restraining plate 470 is located in the second restraining space 700. The first and second intermediate restraining plates (460, 470) are both fixedly connected to the lateral restraining plate 440.

The first and second intermediate restraining plates (460, 470) are positioned in the spaces between the transition segments of the first, second, and third core plates (310, 320, 330). This arrangement provides effectively restraint for the buckling deformation of the first core plate 310 on both sides along the second direction, the downward buckling deformation of the second core plate 320, and the upward buckling deformation of the third core plate 330, ensuring the e energy dissipation component 300 remains stable during deformation.

Referring to FIG. 2, in this embodiment, arc chamfers are provided at the junctions between the transition segment and the connection segments of the first, second and third transition segments (311, 321, 331). This configuring can effectively alleviate the stress concentration between the transition segments and the corresponding connection segments, thereby extending the service life of the energy dissipation component 300.

Referring to FIG. 2, in this embodiment, along the first direction, the size of the first and second restraining spaces (600, 700) is larger than the size of the first and second intermediate restraining plate (460, 470), respectively. Specifically, the lengths of the first and second transition segments (311, 321) are larger than the length of the first intermediate restraining plate 460, and the lengths of the first and third transition segments (311, 331) are larger than the length of the second intermediate restraining plate 470. This configuration provides a space margin for the buckling deformation of the energy dissipation component 300 along the first direction.

In this embodiment, along the third direction, the sizes of the first and second intermediate restraining plates (460, 470) are both 0.5-3 mm larger than the size of the energy dissipation component 300. In other words, the thicknesses of the first and second intermediate restraining plates (460, 470) are both 0.5-3 mm larger than the thickness of the energy dissipation component 300.

The above arrangement ensures that the projection profile of the energy dissipation component 300 in the second direction fits entirely within the first and second intermediate restraining plates (460, 470), effectively restraining the deformation of the energy dissipation component 300 in the second direction by the first and second intermediate restraining plates (460, 470). By configuring the thickness of the first and second intermediate restraining plates (460, 470) to be 0.5 to 3 mm greater than that of the energy dissipation component 300, it is not only prevents the first and second intermediate restraining plates (460, 470) from being too thin to provide an effective restraining effect, but also to avoid the material waste and the overall thickness of the device due to the first and second intermediate restraining plates (460, 470) being too thick.

Referring to FIGS. 2 and 3, in this embodiment, the restraining component 400 can further include a top restraining plate 480 and a bottom restraining plate 490. These restraining plates are respectively arranged on both sides of the energy dissipation component 300 along the third direction and are in contact with the energy dissipation component 300. The top and bottom restraining plates (480, 490) are both fixedly connected to the lateral restraining plate 440.

The provision of the top and bottom restraining plates (480, 490) provides overall the restraining of the buckling deformation of the energy dissipation component 300 as a whole on both sides along the third direction, which is beneficial to the buckling deformation of the energy dissipation component 300 along the first direction.

Referring to FIGS. 2 and 3, in this embodiment, the cross-sections of the top and bottom restraining plates (480, 490) are both T-shaped, wherein the vertical section of the T-shape abuts against the energy dissipation component 300, and the horizontal section of the T-shape is fixedly connected to the lateral restraining plate 440.

This structure of the top and bottom restraining plates (480, 490) not only allows for an effective restraining force on the energy dissipation component 300 in the second direction, but also ensures a reliable connection with the lateral restraining plate 440.

Referring to FIGS. 2 and 3, in this embodiment, the cross-section of the lateral restraining plate 440 is [-shaped, the vertical section of the [-shape is connected to the first supporting plate 100, the energy dissipation component 300 and the second supporting plate 200. The horizontal section of the [-shape is fixedly connected to the top restraining plate 480 and the bottom restraining plate 490.

This structure of the lateral restraining plate 440 not only exerts an effective restraining force on the energy dissipation component 300 in the third direction, but also ensures a reliable connection with both the top restraining plate 480 and the lateral restraining plate 440.

Referring to FIGS. 2 and 3, in this embodiment, the first supporting plate 100 may include a first connecting plate 110 and several first rib plates 120 arranged on the first connecting plate 110. The first connecting plate 110 is used to connect with the energy dissipation component 300.

This arrangement of the first supporting plate 100 not only ensures effective connection with one end of the energy dissipation component 300, but also provides a high structural strength.

Similarly, the second supporting plate 200 may include a second connecting plate 210 and several second rib plates 220 arranged on the second connecting plate 210. The second connecting plate 210 is used to connect with the energy dissipation component 300.

This arrangement of the second supporting plate 200 not only ensures effective connection with the other end of the energy dissipation component 300, but also provides a high structural strength.

Referring to FIGS. 2 and 3, in this embodiment, the energy dissipation component 300 is detachably connected to the first and second supporting plates (100, 200) and the restraining component 400.

This detachable design provides two significant advantages. On the one hand, An energy dissipation component 300 of the multi-stage buckling-restrained brace device with the appropriate strength can be selected and installed to suit specific project requirements and working conditions. On the other hand, if the energy dissipation component 300 is damaged, maintenance only requires of the multi-stage buckling-restrained brace device replacing the energy dissipation component 300 rather than entire device, thereby greatly reducing maintenance costs.

In the following, the replacement process of the first, second and third core plate (310, 320, 330) in the energy dissipation component 300 will be described in detail.

Figure 12:
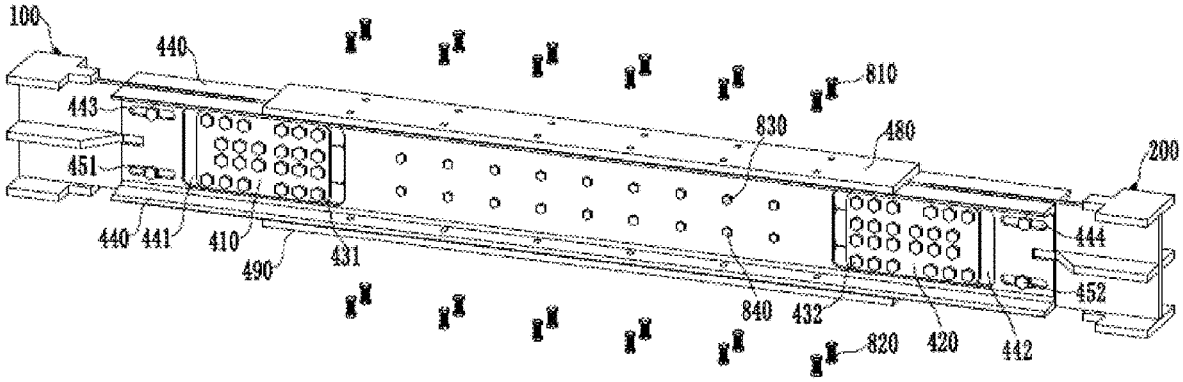
FIG. 12 is a schematic view of the first step in replacing the procedure of the energy dissipation core plate of the multi-stage buckling-restrained brace device according to an embodiment of the present disclosure.

Step 1: As illustrated in FIG. 12, a schematic view of the first step in replacing the procedure of the energy dissipation core plate of the multi-stage buckling-restrained brace device in this embodiment is presented. The fifth and sixth connecting components (810, 820) for connecting the top and bottom restraining plates (480, 490) with the lateral restraining plate 440 can be removed to release the fixing effect on the top and bottom restraining plates (480, 490).

Figure 13:
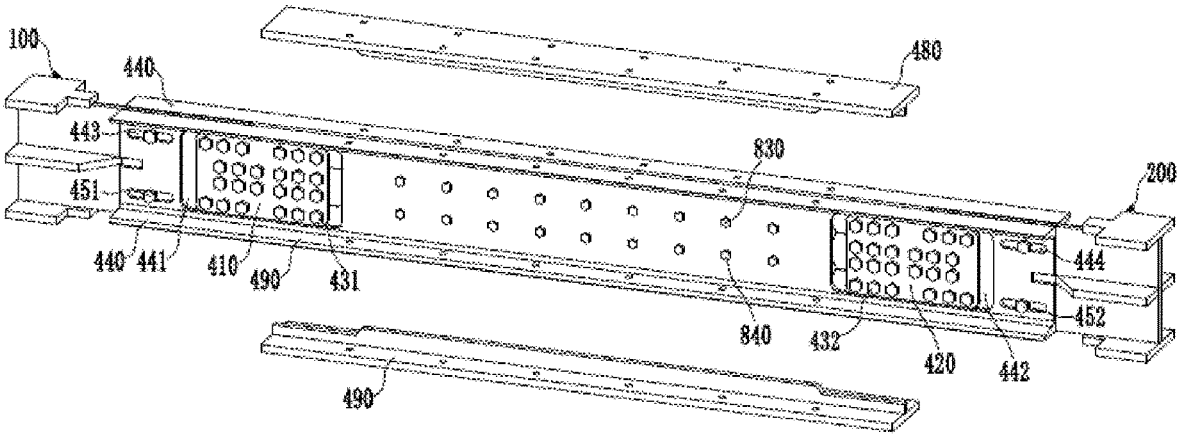
FIG. 13 is a schematic view of the second step in replacing the procedure of the energy dissipation core plate of the multi-stage buckling-restrained brace device according to an embodiment of the present disclosure.

Step 2: As shown in FIG. 13, a schematic view of the second step in replacing the procedure of the energy dissipation core plate of the multi-stage buckling-restrained brace device in this embodiment is presented. The top and bottom restraining plates (480, 490) can be removed.

Figure 14:
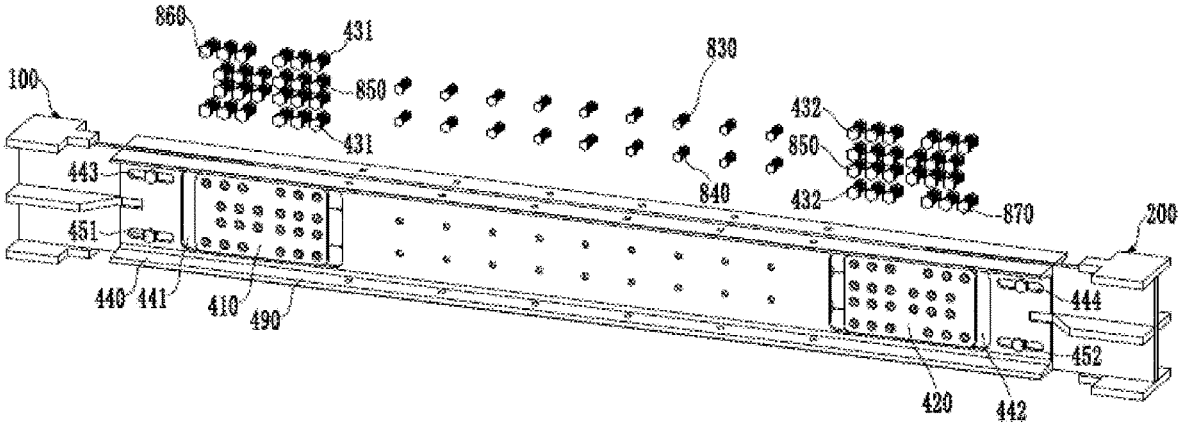
FIG. 14 is a schematic view of the third step in replacing the procedure of the energy dissipation core plate of the multi-stage buckling-restrained brace device according to an embodiment of the present disclosure.

Step 3: As shown in FIG. 14, a schematic view of the third step in replacing the procedure of the energy dissipation core plate of the multi-stage buckling-restrained brace device in this embodiment is presented. multiple connecting components are now removed to disassemble the main assembly. This includes removing the following:

The first and second connecting components (431, 432), which connects the first and second sliding plates (410, 420) to the second and third core plates (320, 330), are removed. The core plate connecting component 850, which connects the first core plate 310 to the first and second sliding plates (410, 420), is removed. The seventh and eighth connecting components (830, 840), which connects the lateral restraining plate 440 to the first and second intermediate restraining plates (460, 470), are removed. The ninth and tenth connecting components (860, 870), which connects the first and second sliding plates (410, 420) to the first and second connecting plates (110, 210), are removed. Removing these components releases the fixing effect on the first and second sliding plates (410, 420) and the lateral restraining plate 440.

Figure 15:
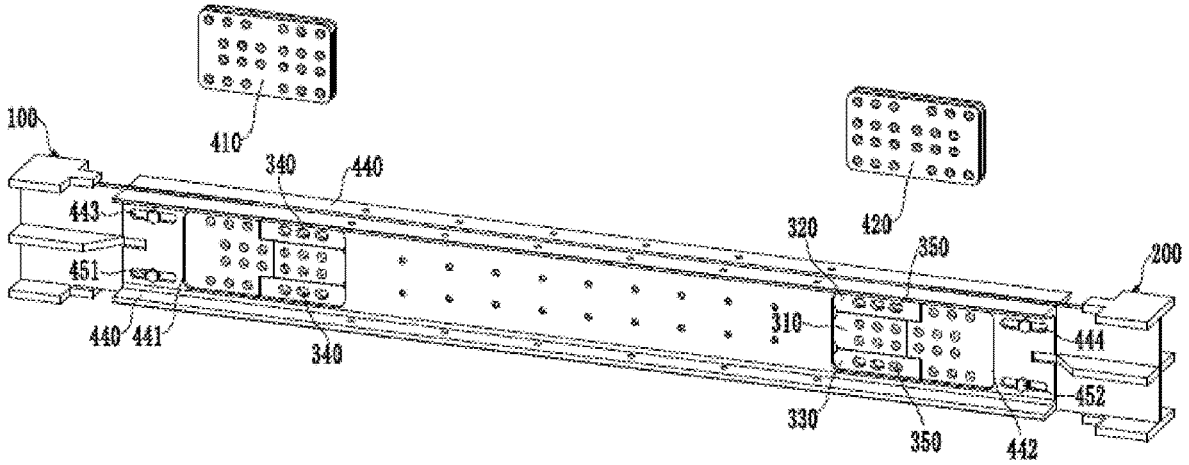
FIG. 15 is a schematic view of the fourth step in replacing the procedure of the energy dissipation core plate of the multi-stage buckling-restrained brace device according to an embodiment of the present disclosure.

Step 4: As illustrated in FIG. 15, a schematic view of the fourth step in replacing the procedure of the energy dissipation core plate of the multi-stage buckling-restrained brace device in this embodiment is presented. The first and second sliding plates (410, 420) are removed.

Figure 16:
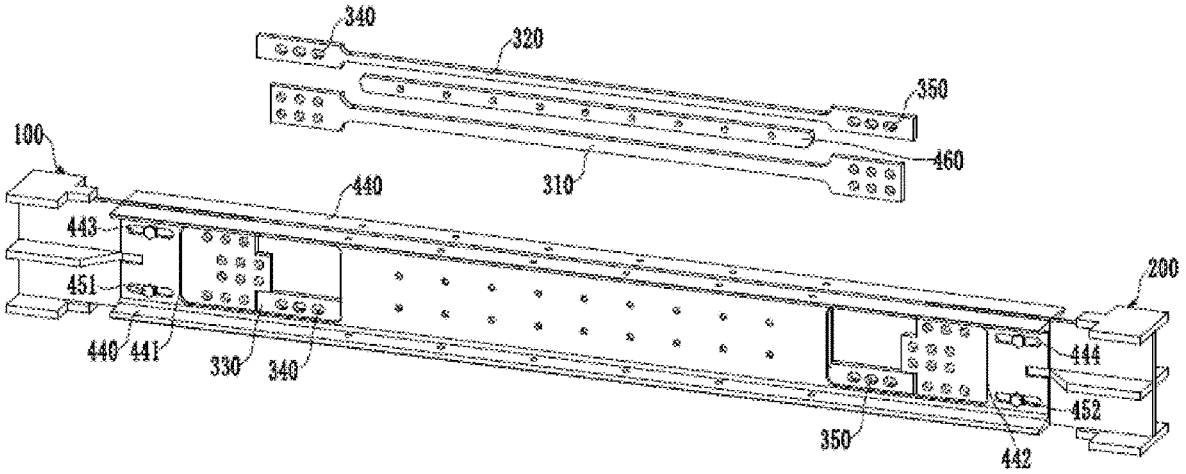
FIG. 16 is a schematic view of the fifth step in replacing the procedure of the energy dissipation core plate of the multi-stage buckling-restrained brace device according to an embodiment of the present disclosure.

Step 5: As illustrated in FIG. 16, a schematic view of the fifth step in replacing the procedure of the energy dissipation core plate of the multi-stage buckling-restrained brace device in this embodiment is presented. The first and second core plates (310, 320) and the first intermediate restraining plate 460 are removed.

Figure 17:
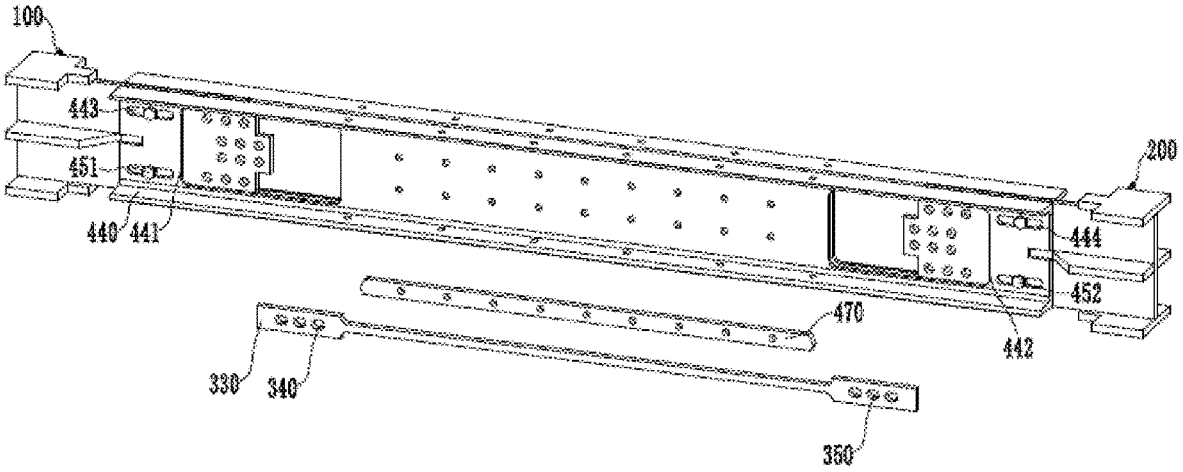
FIG. 17 is a schematic view of the sixth step in replacing the procedure of the energy dissipation core plate of the multi-stage buckling-restrained brace device according to an embodiment of the present disclosure.

Step 6: As illustrated in FIG. 17, a schematic view of the sixth step in replacing the procedure of the energy dissipation core plate of the multi-stage buckling-restrained brace device in this embodiment is presented. The third core plate 330 and the second intermediate restraining plate 470 are removed.

Thus, the first, second and third core plates (310, 320, 330) of the energy dissipation component 300 are disassembled. The assembly process of the first, second and third core plates (310, 320, 330) is opposite to the disassembly process.

Although the present disclosure has been disclosed above, the present disclosure is not limited these embodiments. Any person skilled in the art can make various changes and modifications without departing from the spirit and scope of the present disclosure. Therefore, the protection scope of the present disclosure should be subject to the scope defined by the claims.

Finally, it should be noted that in this specification, relational terms such as "first" and "second", etc. are only used to distinguish one entity or operation from another entity or operation, and do not necessarily require or imply any such actual relationship or order between these entities or operations. Moreover, the term "comprise" or any other variant thereof is intended to cover non-exclusive inclusion, such that a process, method, article or device including a series of elements includes not only those elements but also other elements not explicitly listed, as well as any elements inherent to such process, method, article or device. In the absence of further restrictions, the elements defined by the sentence "comprises a . . . " do not exclude the presence of additional identical elements in the process, method, article or device including the elements.

In the above embodiments, the descriptions of directions such as "inside" and "outside" are all based on the drawings.

The above description of the disclosed embodiments enables one skilled in the art to implement or use the present disclosure. Various modifications to these embodiments will be apparent to those skilled in the art, and the general principles defined herein may be implemented in other embodiments without departing from the spirit or scope of the present disclosure. Therefore, the present disclosure will not be limited to the embodiments shown herein, but rather to the widest scope consistent with the principles and novel features disclosed herein.

What is claimed is:

1. A multi-stage buckling-restrained brace device, comprising a first supporting plate (100) and a second supporting plate (200) spaced apart from each other along a first direction, an energy dissipation component (300) located between the first supporting plate (100) and the second supporting plate (200), and a restraining component (400) configured to restrain the energy dissipation component (300) from buckling under compression wherein the restraining component (400) comprises a first sliding plate (410), a second sliding plate (420). a first connecting component (431) and a second connecting component (432); the energy dissipation component (300) comprises a first core plate (310) and a plurality of high-stage core plates arranged side-by-side with the first core plate (310); the first sliding plate (410) is fixedly connected to a first end of the first core plate (310) and the first supporting plate (100); the second sliding plate (420) is fixedly connected to a second end of the first core plate (310) and the second supporting plate (200); opposing ends of each of the high-stage core plates are respectively spaced from the first supporting plate (100) and the second supporting plate (200) to form adjustable gaps (500) between the high-stage core plates and the first supporting plate (100) and between the high-stage core plates and the second supporting plate (200); a first long hole (340) is formed at a first end of each high-stage core plate, and a second long hole (350) is formed at a second end of each high-stage core plate; the first long hole (340) and the second long hole (350) both extend along the first direction; the first sliding plate (410) is formed with a first connection hole (411) opposite to the first long hole (340); the first connecting component (431) passes through the first connection hole (411) and the first long hole (340); the second sliding plate (420) is formed with a second connection hole (421) opposite to the second long hole (350); and the second connecting component (432) passes through the second connection hole (421) and the second long hole (350);

wherein the plurality of high-stage core plates consists of a second core plate (320) and a third core plate (330), the second core plate (320) and the third core plate (330) are respectively arranged on opposite sides of the first core plate (310) along a second direction, and the first core plate (310), the second core plate (320) and the third core plate (330) are arranged side-by-side, and an adjustable gap (500) formed between the second core plate (320) and the first supporting plate (100) is different from an adjustable gap (500) formed between the third core plate (330) and the first supporting plate (100), and the second direction is perpendicular to the first direction;

wherein the restraining component (400) further comprises a lateral restraining plate (440) arranged on a side of the energy dissipation component (300), the lateral restraining plate (440) is provided with a first limiting slot (441) at a portion adjacent to the first supporting plate (100) and the energy dissipation component (300), and a second limiting slot (442) at a portion adjacent to the second supporting plate (200) and the energy dissipation component (300); the first sliding plate (410) is accommodated in the first limiting slot (441), and the second sliding plate (420) is accommodated in the second limiting slot (442); along the first direction, a sliding distance of the first sliding plate (410) in the first limiting slot (441) and a sliding distance of the second sliding plate (420) in the second limiting slot (442) are both greater than a sliding distance of the first connecting component (431) in the first long hole (340) and a sliding distance of the second connecting component (432) in the second long hole (350); the lateral restraining plate (440) and the energy dissipation component (300) are arranged along a third direction, and the third direction is perpendicular to both the first direction and the second direction; and wherein the first core plate (310) comprises a first transition segment (311) and first connection segments (312) arranged at opposing ends of the first transition segment (311), and the first connection segments (312)

are configured to connect with the first supporting plate (100) and the second supporting plate (200); the second core plate (320) comprises a second transition segment (321) and second connection segments (322) arranged at opposing ends of the second transition segment (321), and the second connection segments (322) are configured to connect with the first supporting plate (100) and the second supporting plate (200); the third core plate (330) comprises a third transition segment (331) and third connection segments (332) arranged at opposing ends of the third transition segment (331), and the third connection segments (332) are configured to connect with the first supporting plate (100) and the second supporting plate (200), wherein a first restraining space (600) is formed between the first transition segment (311) and the second transition segment (321), and a second restraining space (700) is formed between the first transition segment (311) and the third transition segment (331); the restraining component (400) further comprises a first intermediate restraining plate (460) and a second intermediate restraining plate (470), wherein the first intermediate restraining plate (460) is located in the first restraining space (600), and the second intermediate restraining plate (470) is located in the second restraining space (700), and both the first intermediate restraining plate (460) and the second intermediate restraining plate (470) are fixedly connected to the lateral restraining plate (440).

2. The multi-stage buckling-restrained brace device of claim 1, wherein the restraining component (400) further comprises a third connecting component (451) and a fourth connecting component (452), the lateral restraining plate (440) is provided at one end with a first safety hole (443) extending along the first direction, the first supporting plate (100) is provided with a first supporting plate hole (111) opposite to the first safety hole (443), the third connecting component (451) passes through the first supporting plate hole (111) and the first safety hole (443), and along the first direction, a sliding stroke of the third connecting component (451) in the first safety hole (443) is greater than a sliding stroke of the first connecting component (431) in the first long hole (340) and a sliding stroke of the second connecting component (432) in the second long hole (350); the lateral restraining plate (440) is provided at the other end with a second safety hole (444) extending along the first direction; the second supporting plate (200) is provided with a second supporting plate hole (211) opposite to the second safety hole (444), the fourth connecting component (452) passes through the second supporting plate hole (211) and the second safety hole (444), and along the first direction, a sliding stroke of the fourth connecting component (452) in the second safety hole (444) is greater than a sliding stroke of the first connecting component (431) in the first long hole (340) and a sliding stroke of the second connecting component (432) in the second long hole (350).

3. The multi-stage buckling-restrained brace device of claim 2, wherein the restraining component (400) further comprises a top restraining plate (480) and a bottom restraining plate (490), and the top restraining plate (480) and the bottom restraining plate (490) are respectively arranged on opposite sides of the energy dissipation component (300) along the third direction and abut against the energy dissipation component (300); the top restraining plate (480) and the bottom restraining plate (490) are both fixedly connected to the lateral restraining plate (440).

4. The multi-stage buckling-restrained brace device of claim 3, wherein at least one of: (i) cross-sections of the top restraining plate (480) and the bottom restraining plate (490) are both T-shaped, a vertical section of each T-shaped cross-section abuts against the energy dissipation component (300), and a horizontal section of each T-shaped cross-section is fixedly connected to the lateral restraining plate (440); and (ii) a cross-section of the lateral restraining plate (440) is channel-shaped and has a vertical section and horizontal sections, the vertical section is connected to the first supporting plate (100), the energy dissipation component (300) and the second supporting plate (200), and the horizontal sections are fixedly connected to the top restraining plate (480) and the bottom restraining plate (490).

5. The multi-stage buckling-restrained brace device of claim 1, wherein the sizes of the first intermediate restraining plate (460) and the second intermediate restraining plate (470) along the third direction are both 0.5 to 3 mm larger than a size of the energy dissipation component (300).

6. The multi-stage buckling-restrained brace device of claim 1, wherein there are two lateral restraining plates (440), and the two lateral restraining plates (440) are respectively arranged on opposite sides of the energy dissipation component (300) along the third direction.

7. The multi-stage buckling-restrained brace device of claim 1, wherein at least one of: (i) the first supporting plate (100) comprises a first connecting plate (110) and a plurality of first rib plates (120) arranged on the first connecting plate (110), and the first connecting plate (110) is configured to connect with the energy dissipation component (300): (ii) the second supporting plate (200) comprises a second connecting plate (210) and a plurality of second rib plates (220) arranged on the second connecting plate (210), and the second connecting plate (210) is configured to connect with the energy dissipation component (300); and (iii) the energy dissipation component (300) is detachably connected to the first supporting plate (100), the second supporting plate (200) and the restraining component (400).

* * * * *